US010731277B2

(12) United States Patent
Park

(10) Patent No.: US 10,731,277 B2
(45) Date of Patent: Aug. 4, 2020

(54) METHOD OF PRODUCING HEMP-BLENDED SINGLE SPUN YARN

(71) Applicant: Jungeun Park, Busan (KR)

(72) Inventor: Jungeun Park, Busan (KR)

( * ) Notice: Subject to any disclaimer, the term of this patent is extended or adjusted under 35 U.S.C. 154(b) by 24 days.

(21) Appl. No.: 16/027,076

(22) Filed: Jul. 3, 2018

(65) Prior Publication Data

US 2019/0106812 A1 Apr. 11, 2019

(30) Foreign Application Priority Data

Oct. 11, 2017 (KR) ..... 10-2017-0129700

(51) Int. Cl.

| | |
|---|---|
| ***D02G 3/36*** | (2006.01) |
| ***D02G 3/04*** | (2006.01) |
| ***D01G 13/00*** | (2006.01) |
| ***D01H 13/30*** | (2006.01) |
| ***D01G 9/14*** | (2006.01) |

(52) U.S. Cl.

CPC ..... *D02G 3/36* (2013.01); *D01G 9/14* (2013.01); *D01G 13/00* (2013.01); *D01H 13/306* (2013.01); *D02G 3/04* (2013.01); *D10B 2201/01* (2013.01); *D10B 2331/02* (2013.01); *D10B 2331/10* (2013.01); *D10B 2401/061* (2013.01)

(58) Field of Classification Search

CPC .. D02G 3/04; D02G 3/32; D02G 3/36; D02G 3/38; D01G 13/00

See application file for complete search history.

(56) References Cited

U.S. PATENT DOCUMENTS

| | | | | |
|---|---|---|---|---|
| 27,877 A * | 4/1860 | Allen | A61K 38/00 162/143 |
| 4,069,656 A * | 1/1978 | Arai | D02G 3/38 57/207 |
| 6,460,322 B1 * | 10/2002 | Sato | D02G 3/324 57/225 |
| 8,093,160 B2 * | 1/2012 | Tharpe, Jr. | D01H 1/00 442/191 |

(Continued)

FOREIGN PATENT DOCUMENTS

| | | |
|---|---|---|
| KR | 10-0575473 B1 | 5/2006 |
| KR | 10-2007-0118526 A | 12/2007 |

(Continued)

*Primary Examiner* — Shaun R Hurley

(74) *Attorney, Agent, or Firm* — KORUS Patent, LLC; Seong Il Jeong

(57) ABSTRACT

A method of producing a hemp-blended single spun yarn may include: a fiber blending step of passing hemp fiber, together with latent crimped yarn fiber, through an opener in order to increase the cohesion of the hemp fiber by the three-dimensional chain structure, thereby producing a blended fiber including 10% to 60% latent crimped yarn fiber; a sliver production step of carding the blended fiber through a carding machine, and drafting the carded fiber through a drafting machine, thereby producing a sliver; and a spinning step of supplying the sliver as a roving yarn through a plurality of rollers to a twisting unit, and supplying a combined filament yarn, produced by twisting and having a structure in which a low-stretchability filament yarn surrounds a high-stretchability filament yarn, as a core yarn to the twisting unit without being passed through the plurality of rollers.

3 Claims, 7 Drawing Sheets

(56) References Cited

U.S. PATENT DOCUMENTS

| | | | | |
|---|---|---|---|---|
| 2002/0014066 | A1* | 2/2002 | Lefebvre | D01H 4/00 57/334 |
| 2002/0026781 | A1* | 3/2002 | Shigeyama | D01H 1/115 57/12 |
| 2008/0299855 | A1* | 12/2008 | Morihashi | D02G 3/36 442/181 |
| 2009/0173055 | A1* | 7/2009 | Silver | D01G 11/00 57/256 |
| 2010/0139237 | A1* | 6/2010 | Liu | D01H 13/302 13/302 |
| 2014/0208491 | A1* | 7/2014 | Schmitt | A41D 31/08 2/458 |
| 2015/0044449 | A1* | 2/2015 | Foss | C08K 3/22 428/221 |
| 2016/0024692 | A1* | 1/2016 | Yung | D02G 3/04 139/421 |

FOREIGN PATENT DOCUMENTS

| | | | |
|---|---|---|---|
| KR | 10-2010-0137167 | A | 12/2010 |
| KR | 10-1459235 | B1 | 11/2014 |
| KR | 10-2015-0118282 | A | 10/2015 |

* cited by examiner (a) Enlarged view of hemp fiber (b) Enlarged view of latent and potential crimped yarn fiber (c) Enlarged view of hemp-blended sliver (d) Enlarged view of untangled hemp-blended sliver (a) Hemp-blended single spun yarn produced by a conventional method (b) Hemp-blended single spun yarn produced according to the present invention

METHOD OF PRODUCING HEMP-BLENDED SINGLE SPUN YARN

BACKGROUND

1. Technical Field

The present invention relates to a method of producing a hemp-blended single spun yarn, and more specifically to a method of producing a hemp-blended single spun yarn by blending hemp fiber with other fiber to overcome the disadvantage of hemp fiber which is difficult to spin due to its characteristics, such as high rigidity, non-stretchability, non-crimping and the like.

2. Description of the Related Art

Hemp is the oldest fiber material which has been used by mankind for thousands of years, and is a vegetable fiber material which belongs to the world's two major natural fibers along with cotton. It has 10 times more durability than cotton fiber. It also contains many pores between cellulose fibers, and thus has excellent sweat-absorbing ability, sweat-releasing ability and air permeability, which are at least two times higher than those of cotton fibers. In addition, hemp is known to have excellent deodorizing ability and antibacterial activity.

Hemp having various functions as described above can be applied to all kinds of fashion products, including underwear, sportswear, jeans, bedclothes and socks. In addition to use for fabrics, hemp is used in industrial fields, including the paper pulp industry, the pharmaceutical industry, the food industry, the fuel industry, the cosmetic industry and the like. Thus, hemp fabrics suitable for environmentally friendly trends such as LOHAS and eco, which are concepts more advanced than the recent well-being trend, are expected to increase consumer purchasing power, and thus the value of hemp as health fabrics is rapidly increasing.

However, hemp fiber is rigid, is not stretchable, and has no crimp, indicating that it is very difficult to spin alone. In addition, even if hemp is spun, the spun hemp has problems in that it is not flexible due to its roughness and stiffness, excessively wrinkles due to lack of flexibility, has very low elongation, and also gives low wearing comfort and mobility due to a disadvantage such as excessive mowing.

SUMMARY

An object of the present invention is to provide a method of producing a hemp-blended single spun yarn, which can overcome difficulty in hemp spinning by blending hemp and latent and potential crimped yarn fiber in order to increase the cohesion of hemp.

Another object of the present invention is to provide a method of producing a hemp-blended single spun yarn, which gives excellent wearing comfort and mobility by resolving the problems of hemp fiber including roughness, stiffness, and excessive mowing compared to other fibers.

Objects which are to be achieved by the present invention are not limited to the above-mentioned objects, and other objects of the present invention will be clearly understood by those skilled in the art from the following description.

To achieve the above objects, the present invention provides a method of producing a hemp-blended single spun yarn, the method including: a fiber blending step of passing hemp fiber, together with latent and potential crimped yarn fiber, through an opener in order to increase the cohesion of the hemp fiber by the three-dimensional chain structure of the latent and potential crimped yarn fiber, thereby producing a blended fiber including 10% to 60% latent and potential crimped yarn fiber; a sliver production step of carding the blended fiber through a carding machine, and drafting the carded fiber through a drafting machine, thereby producing a sliver; and a spinning step of supplying the sliver as a roving yarn through a plurality of rollers to a twisting unit, and supplying a combined filament yarn, produced by twisting and having a structure in which a low-stretchability filament yarn surrounds a high-stretchability filament yarn, as a core yarn to the twisting unit without being passed through the plurality of rollers, wherein the combined filament yarn enters a position on top of the twisting unit, at which twisting of 5% to 20% of a target twisting number is performed.

Meanwhile, in the present invention, when the yarn number of the finally produced hemp-blended single spun yarn is equal to or larger than a threshold yarn number, the carded sliver may be subjected to a combing process and supplied to the drafting machine, and when the yarn number of the finally produced hemp-blended single spun yarn is smaller than the threshold yarn number, the combing process may not be performed. In this case, the threshold yarn number of the hemp-blended single spun yarn may be 48 (nm 48's/ne 25's).

The method of producing the hemp-blended single spun yarn may further include a step of spraying a mixture solution of water and an emulsifier during a process in which the blended fiber is discharged through the opener or during a process in which the fibers are supplied to the opener, in order to prevent damage to the hemp fiber and improve spinning workability.

The method of producing the hemp-blended single spun yarn may further include a step of aging the hemp fiber by spraying a mixture solution of water and an emulsifier thereto in an aging room before the hemp fiber is supplied to the opener, in order to prevent damage to the hemp fiber and improve spinning workability.

The combined filament yarn is preferably unwound from a winding unit at a constant speed, descends via a guiding bar, passes vertically in a zigzag pattern (downward, upward and then downward) through three horizontally interconnected rings provided in a tension control ring unit, and enters the position at which twisting of 5% to 20% of the target twisting number is performed. This is to enable the combined filament yarn to capture the mowing in hemp fiber caused by strong torque at the initial stage of twisting and to enter the side of the roving yarn and also to be twisted with the roving yarn, thereby minimizing mowing.

In this case, the entry position of the combined filament yarn may be adjusted either by horizontally moving the tension control ring unit in a state in which vertical movement is fixed, or by vertically moving the tension control ring unit in a state in which horizontal movement is fixed.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
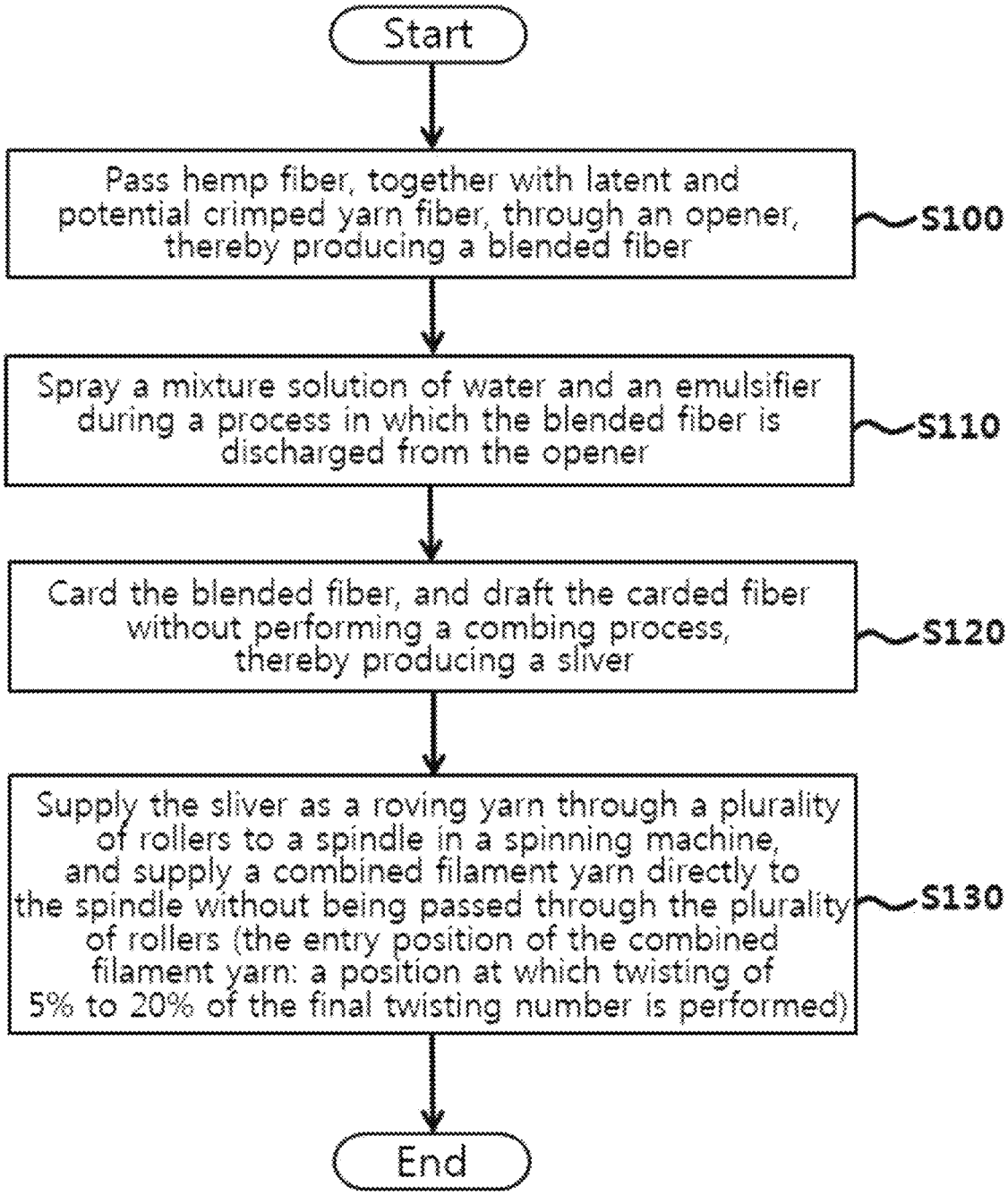
FIG. 1 is a flowchart showing an example of a method of producing a hemp-blended single spun yarn according to the present invention.

Reference should be made to the accompanying drawings illustrating preferred embodiments of the present invention and the descriptions in the drawings in order to fully understand the present invention, the operational or functional advantages of the present invention, and objects to be achieved by the practice of the present invention.

The present invention will be described in detail below by describing preferred embodiments of the present invention with reference to the accompanying drawings. Throughout the drawings, like reference numerals may refer to like components.

Figure 2:
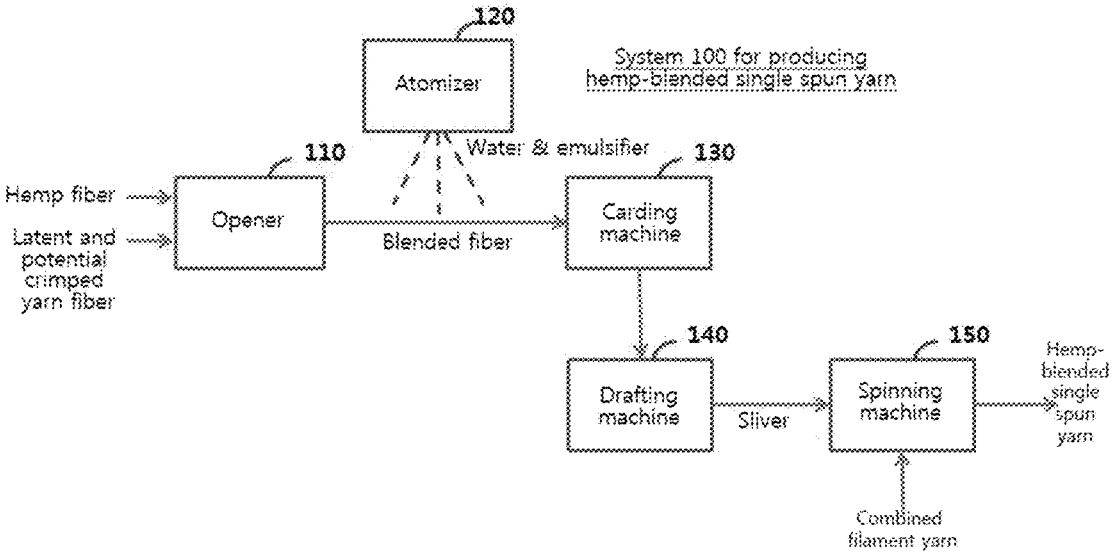
FIG. 2 is a block diagram showing an example of a system for producing a hemp-blended single spun yarn according to the present invention.

FIG. 1 is a flowchart showing an example of a method of producing a hemp-blended single spun yarn according to the present invention. FIG. 2 is a block diagram showing an example of a system 100 for producing a hemp-blended single spun yarn according to the present invention. Meanwhile, the components of the hemp-blended single spun yarn production system 100 shown in FIG. 2 are not essential, and thus the number of components in the hemp-blended single spun yarn production system 100 may be larger or smaller than the number of the components shown in FIG. 2. The same is true for each component of the hemp-blended single spun yarn production system 100. The method of producing a hemp-blended single spun yarn according to the present invention will be described below with reference to necessary drawings.

First, hemp fiber and latent and potential crimped yarn fiber are passed together through an opener 110, thereby producing a blended fiber in S100. The reason why the latent and potential crimped yarn is blended is to increase spinning efficiency by increasing the cohesion of hemp fiber due to the three-dimensional chain structure of the latent and potential crimped yarn. In this regard, the blending proportion of the latent and potential crimped yarn is preferably about 10% to 60%. The reason for this is that the cohesion of hemp fiber by the latent and potential crimped yarn will be weak so that spinning efficiency can be reduced when the blending proportion of the latent and potential crimped yarn is less than 10% and the characteristic advantages of hemp fiber will be weakly exhibited when the blending proportion of the latent and potential crimped yarn is more than 60%.

When the blended fiber according to step S100 is discharged through the opener 110, a mixture solution of water and an emulsifier is sprayed from an atomizer 120 in step S110. Then, water and the emulsifier are absorbed into the hemp fiber having excellent water-absorbing ability, and for this reason, the hemp fiber can be prevented from being cut or damaged in a spinning step while spinning workability can be improved.

Meanwhile, in another embodiment of the present invention, the method may include a step of pre-aging the hemp fiber by spraying a mixture solution of water and an emulsifier onto the hemp fiber in an aging room before supplying the hemp fiber to the opener 100. In this case, the prevention of damage to the hemp fiber and improvement in spinning workability can be more easily achieved compared to the case where the mixture solution of water and the emulsifier is sprayed when the blended fiber is discharged from the opener 110 as in step S110. In still another embodiment of the present invention, the mixture solution of water and the emulsifier may also be sprayed during a process in which the hemp fiber is supplied to the opener 110.

In addition, in some cases, the above-described step of spraying the mixture solution of water and the emulsifier or the step of aging the hemp-fiber by spraying water and the emulsifier thereto may also be omitted. This may be the case when the blending proportion of the hemp fiber is as low as 40% or below and the blending proportion of other fiber is high, and thus there is no problem in the cohesion of the hemp fiber.

As the blended fiber is produced according to step S110, the blended fiber is carded through a carding machine 130, and then drafted through a drafting machine 140 without being subjected to a combing process, thereby producing a sliver in step S120. The reason why the combing process is omitted is because if the carded sliver is subjected to the combing process, a fiber originally having a short length or a fiber having a length shortened by splitting or cutting during progression of the process can come out.

Meanwhile, in other embodiments of the present invention, the carded sliver is subjected to the combing process and supplied to the drafting machine when the yarn number of the finally produced hemp-blended single spun yarn is equal to or larger than the threshold yarn number, and the combing process may not be performed when the yarn number of the finally produced hemp-blended single spun yarn is smaller than the threshold yarn number. In this regard, the threshold yarn number of the hemp-blended single spun yarn may be 48 (nm 48's, ne 25's). The reason for this is that if the yarn number is 48 or more, it is preferable to perform combing in order to maintain the uniformity of the fibers. Meanwhile, this threshold yarn number may be changed by taking into account blending of additional fiber, operating conditions, the length of the fibers, and the like.

As the sliver is produced according to step S120, a hemp-blended single spun yarn is produced in a spinning machine 150. This production of the hemp-blended single spun yarn in the spinning machine includes: supplying the sliver as a roving yarn to a twisting unit through a plurality of rollers; and supplying a combined filament yarn, produced by twisting and having a structure in which a high-stretchability filament yarn is surrounded by a low-stretchability filament yarn, as a core yarn to the twisting unit without being passed through the plurality of rollers in step S130. Meanwhile, as used herein, the term "combined filament yarn" means a yarn including a high-stretchability filament yarn and a low-stretchability filament yarn, which are configured as described above.

In this regard, the combined filament yarn preferably enters a position on top of the twisting unit, at which twisting of 5 to 20% of the target twisting number is performed. The reason for this is that mowing of the hemp fiber at the entrance at which twisting is started is caused by strong torque, and when the combined filament yarn enters the above-described position, the combined filament yarn is twisted on the side of the roving yarn while covering (by capturing) the mowed portion, and thus mowing can be significantly reduced. This mechanism will be described in more detail later with reference to FIGS. 4 to 6.

Depending on a twisting start position on top of the spindle, into which the combined filament yarn is introduced, the functionality and appearance of the yarn vary. As it goes toward the top (twisting start point), the core yarn has a stronger tendency to go toward the center of the roving yarn, and thus the elongation of the yarn increases and the core yarn is not exposed to the outside, but the control of mowing is insufficient. When the entry position goes excessively toward the bottom, the mowing control effect is excellent, but the core yarn protrudes to the outside, and thus the cross point increases and the elongation decreases. The entry position is adjusted depending on the intended use and characteristics of the fabric, and is preferably a position at which 5 to 20% of the target twisting number is performed.

Depending on the combined filament yarn which is twisted with the sliver, the characteristics of the hemp-blended single spun yarn can be determined. For example, when the low-stretchability filament yarn has excellent strength, abrasion resistance and peeling properties, the hemp-blended single spun yarn produced according to the present invention may have high strength and abrasion resistance due to the low-stretchability filament yarn. This low-stretchability filament fiber may be one of nylon fiber, poly-based fiber, and aramid fiber. However, the scope of the present invention is not limited thereto. In addition, the high-stretchability filament yarn may be a filament yarn obtained by drawing polyurethane fiber or a high-stretchability latent and potential crimped yarn at a drawing ratio in a predetermined range, and for this reason, the hemp-blended single spun yarn may have significantly improved stretchability compared to hemp.

The effects of the above-described method of producing the hemp-blended single spun yarn are summarized as follows.

- Difficulty in hemp spinning was resolved by blending of the latent and potential crimped yarn fiber.
- As a result of either aging the hemp fiber by spraying the mixture solution of water and the emulsifier thereon or spraying the mixture solution onto the blended fiber which is discharged from the opener or introduced into the opener, damage to the hemp fiber in the spinning step can be prevented and working efficiency can be increased.
- The functions and appearance of the hemp-blended single spun yarn may be changed by the filament yarn which is provided as a core yarn in the spinning step and which is composed of a blend of a low-stretchability filament yarn and a high-stretchability filament yarn.

FIGS. 3A-3D depict enlarged photographs illustrating the increased cohesion of hemp fiber in a sliver including a blend of hemp fiber and latent and potential crimped yarn fiber, produced by the method of producing the hemp-blended single spun yarn according to the present invention.

Figure 3A:
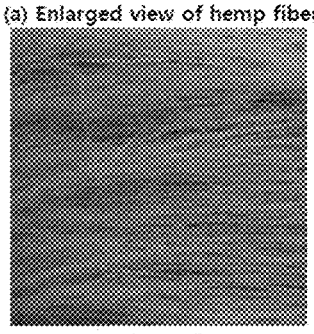
FIGS. 3A-3D depict enlarged photographs illustrating the increased cohesion of hemp fiber in a sliver composed of a blend of hemp fiber and latent and potential crimped yarn fiber, produced by a method of producing a hemp-blended single spun yarn according to the present invention.
Figure 3B:
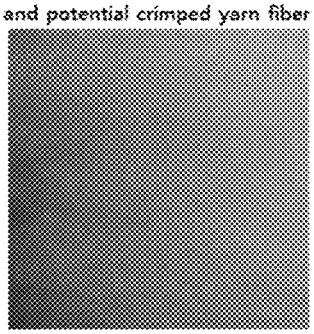

Referring to FIG. 3A, it can be seen that hemp fibers are separated from one another due to their low entanglement property (i.e., cohesion). Due to this property, hemp fibers are characterized in that they are significantly difficult to spin alone. Meanwhile, referring to FIG. 3B, it can be seen that latent and potential crimped yarn fibers are strongly entangled with one another due to their strong cohesion. This strong cohesion of the latent and potential crimped yarn is useful for overcoming the low cohesion of hemp fibers.

Figure 3C:
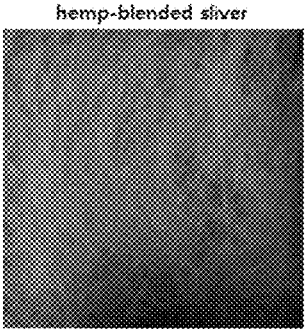
Figure 3D:
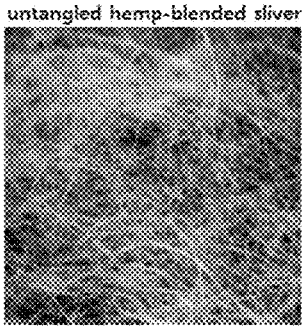

Referring to an enlarged view of a blend-spun sliver shown in FIG. 3C and an enlarged view of an untangled blend-spun sliver composed of hemp fiber and latent and potential crimped yarn, it can be seen that thin latent and potential crimped yarn fibers between thick hemp fibers condense the hemp fibers. As described above, this is possible because the three-dimensional chain structure of the latent and potential crimped yarn fibers capture the hemp fibers. Due to this mechanism, the disadvantage of hemp, which is difficult to spin, due to its low cohesion, is overcome so that the spinning efficiency can be dramatically increased.

Figure 4:
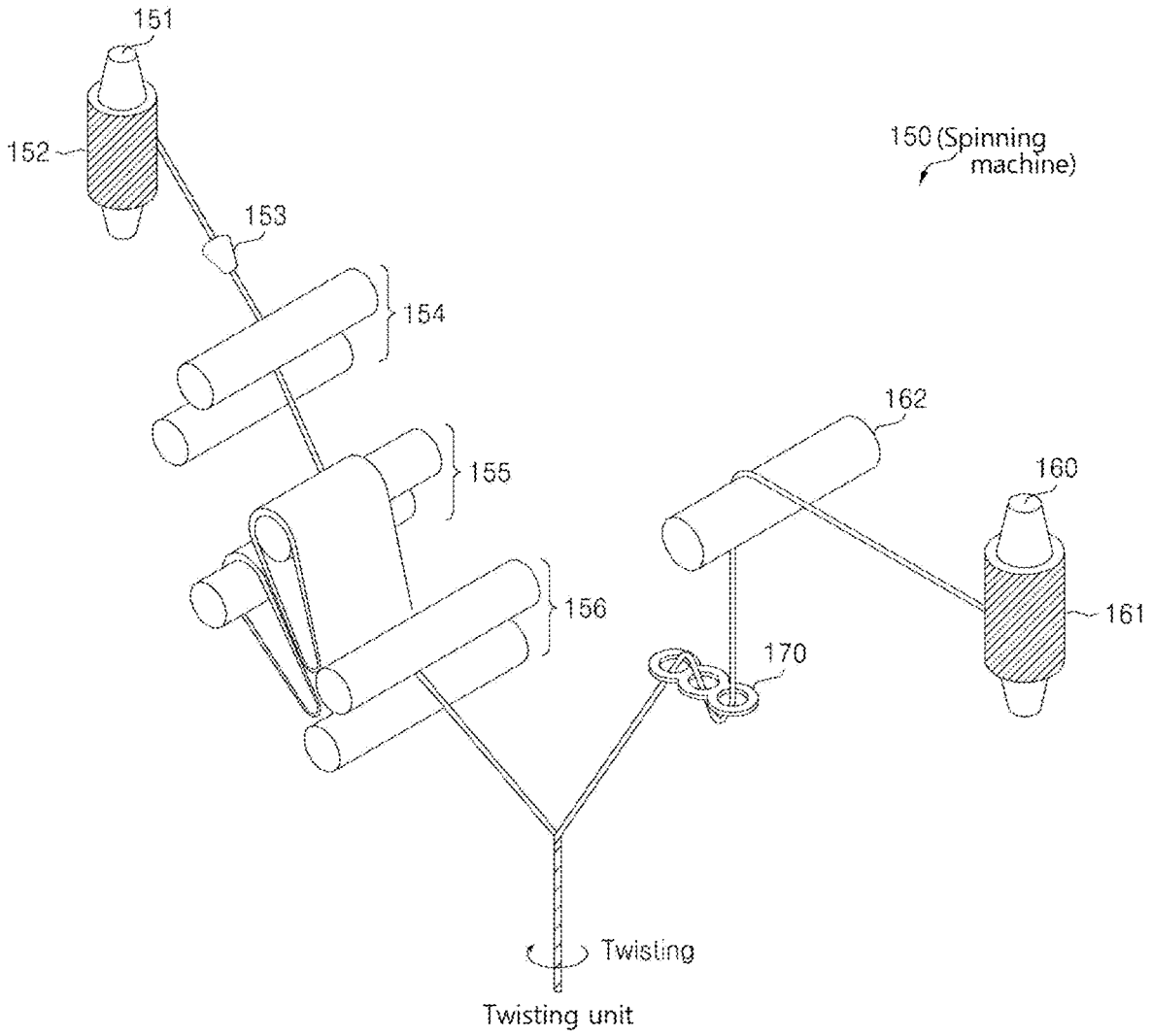
FIG. 4 is a configurational view showing an example of a spinning machine included in a system for producing a hemp-blended single spun yarn according to the present invention.
Figure 5:
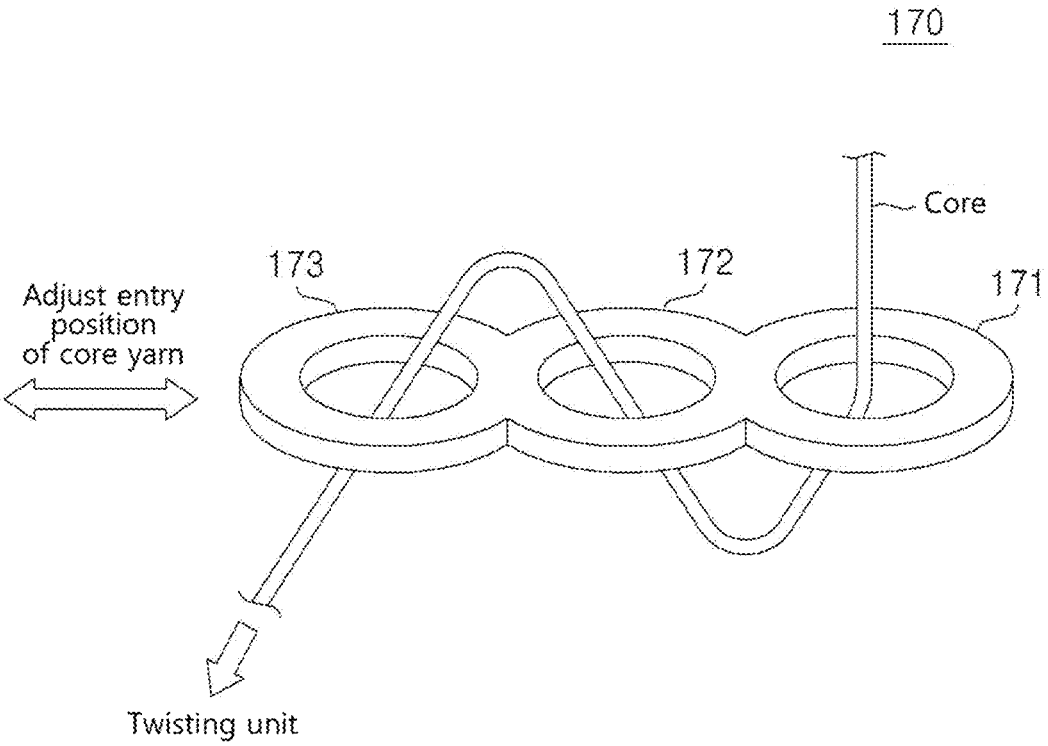
FIG. 5 is an enlarged view of a tension control ring unit included in the spinning machine shown in FIG. 4.

FIG. 4 is a configurational view showing an example of a spinning machine 150 included in the hemp-blended single spun yarn production system according to the present invention. FIG. 5 is an enlarged view of a tension control ring unit 170 included in the spinning machine shown in FIG. 4. Referring to FIG. 4, the spinning machine 150 includes a trumpet 153, a plurality of rollers 154, 155 and 156, a guiding bar 162, and a tension control ring unit 170. For reference, the constituent elements of the spinning machine 150 shown in FIG. 4 are not essential. Therefore, the spinning machine 150 according to the present invention may not include all the constituent elements shown in FIG. 4, and may further include other constituent elements not shown in FIG. 4.

A single fiber roving yarn 152 wound on a winding unit 151 is unwound from the winding unit 151, passes through the trumpet 130, is drafted through the plurality of rollers 154, 155 and 156, and then is supplied to a twisting unit (not shown). Meanwhile, although the spinning machine 150 shown in FIG. 4 include back rollers 154, middle rollers 155, and front rollers 156, it may include a larger number of rollers or a smaller number of rollers depending on embodiments.

On another winding unit 160, a combined filament yarn 161 to be supplied as a core yarn to the spinning machine 150 is wound. The combined filament yarn may be obtained by twisting and composed of a low-stretchability filament yarn and a high-stretchability filament yarn. A technology for twisting of filament yarns is a widely known technology, and thus a detailed description of a process for twisting of the filament yarns is omitted.

The low-stretchability filament yarn may be a portion exhibiting high strength and abrasion resistance and excellent peeling properties among the properties of the blended single spun yarn produced by the blended single spun yarn production system 100. The low-stretchability filament yarn may be full drawn yarn (FDY) obtained using low-stretchability filament fiber and may also be draw textured yarn (DTY).

The low-stretchability filament yarn may be one of nylon fiber, poly fiber, rayon fiber, silk fiber, bamboo fiber, aramid fiber, and ultra high molecular weight polymer (UHMWP) fiber. However, the scope of the present invention is not limited thereto.

In addition, the high-stretchability filament yarn may be a filament yarn obtained by drawing polyurethane fiber or a high-stretchability latent and potential crimped yarn at a drawing ratio in a predetermined range. The high-stretchability filament yarn may be a portion responsible for the stretchability of the finally produced blended single spun yarn.

The combined filament yarn wound on the winding unit 160 is unwound at a constant speed, passes through the guiding bar 162 and the tension control ring unit 170, and is supplied to the twisting unit. The combined filament yarn, unwound from the winding unit 160 at a constant speed and descended via the guiding bar 162, passes vertically in a zigzag fashion (downward, upward, and then downward) through three horizontally interconnected rings provided in the tension control ring unit 170, and is supplied to the twisting unit.

In this case, the entry position of the combined filament yarn (that is, a position at which the combined filament yarn is supplied and starts to twist with the roving yarn in the twisting process) is preferably a position at which twisting of 5 to 20% of the target twisting number for the roving yarn is performed. This entry position of the combined filament yarn is a position at which mowing can be minimized because the combined filament yarn penetrates the roving yarn while covering a mowed portion generated in hemp (included in the roving yarn) due to a centrifugal force caused by twisting.

Meanwhile, the tension control ring unit 170 will now be described in more detail with reference to FIG. 5. The combined filament yarn, unwound from the winding unit 160 and descending via the guiding bar 162, passes downward through a ring 171 located on the rightmost side. Thereafter, the combined filament yarn passes upward through a middle ring 172, and then passes through the leftmost ring 173 and is supplied to the twisting unit.

Thus, while the combined filament yarn passes through the rings 171, 172 and 173 in a zigzag manner, it is prevented from being rapidly unwound from the winding unit 160 and a tension applied thereto is also maintained at a constant level. Meanwhile, the position of the tension control ring unit 170 may be fixed after moving it up and down or left and right to adjust the entry position of the core yarn. This will be described in more detail later with reference to FIGS. 6 and 7.

A combination of the guiding bar 162 and the tension control ring unit 170, described with reference to FIGS. 3 to 5, is merely an example for unwinding, sending and supplying the combined filament yarn at a constant speed. Namely, other embodiments of the present invention may also employ another structure that can apply a constant force so that the combined filament yarn wound on the winding unit 160 can be unwound at a constant speed.

As described above, in the hemp-blended single spun yarn production method according to the present invention, the combined filament yarn does not pass through the rollers 154, 155 and 156 (that is, steps of supplying the roving yarn and the core yarn to the twisting unit are completely separated from each other), process control is easy and the spinning efficiency can be high.

Figure 6:
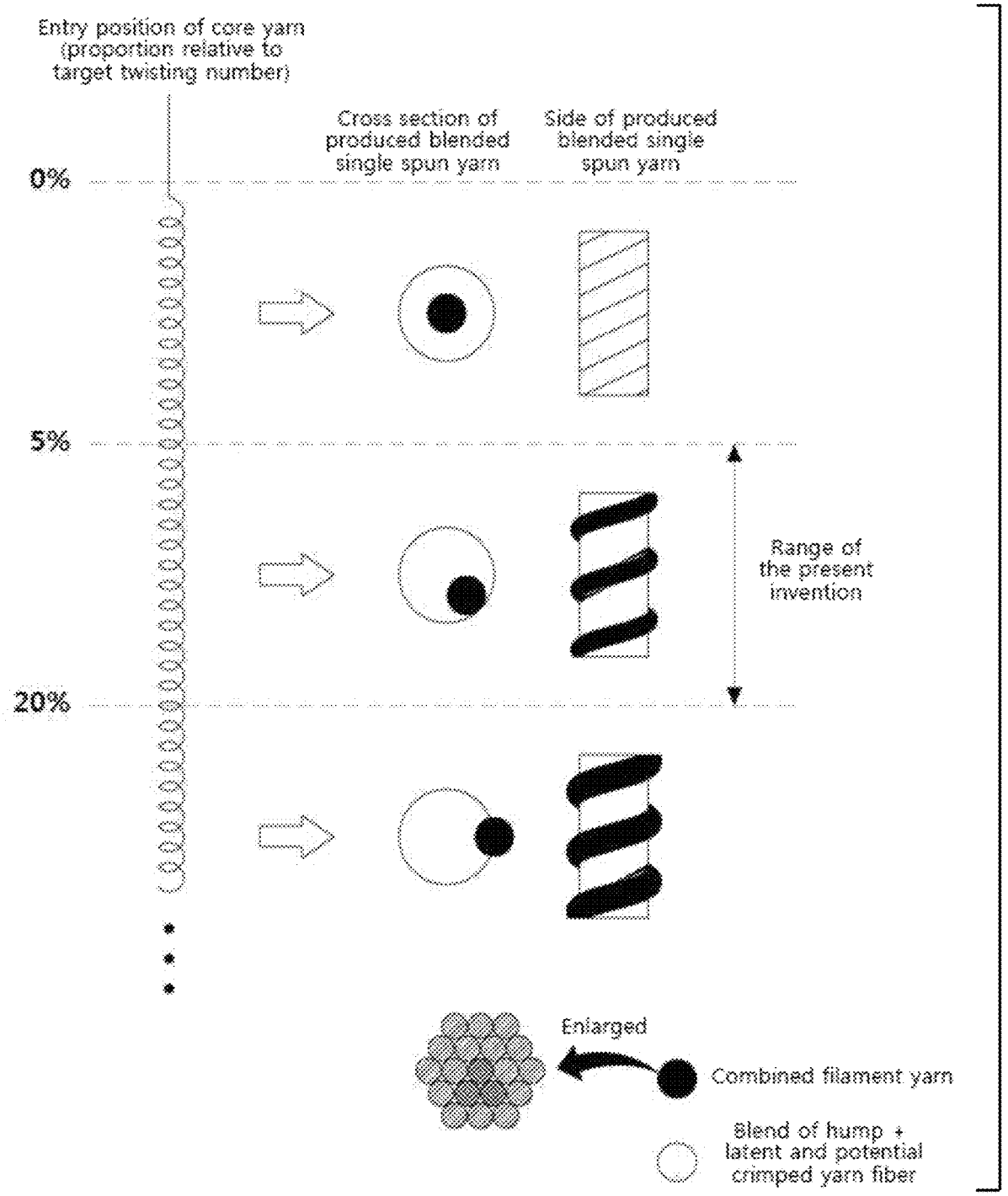
FIG. 6 is a conceptual view illustrating that the properties of a hemp-blended single spun yarn can be adjusted depending on the entry position of a combined filament yarn (which is a core yarn) upon twisting in the spinning machine shown in FIG. 4.

FIG. 6 is a conceptual view illustrating that the properties of the hemp-blended single spun yarn can be adjusted depending on the entry position of the combined filament yarn (which is a core yarn) upon twisting in the spinning machine 150 shown in FIG. 4. For reference, the entry position of the combined filament yarn indicates the ratio of a position on top of the twisting unit after twisting to the final target twisting number.

First, if the entry position of the combined filament yarn is less than 5% of the final twisting number, the core yarn will enter the roving yarn and will not be easily visible. In this case, the stretchability will increase, but mowing control will be insufficient, indicating that this entry position is not suitable for hemp yarn spinning.

Next, if the entry position of the combined filament yarn is 5 to 20% of the final twisting number as disclosed in the present invention, the combined filament yarn supplied as a core yarn will capture a mowed portion and penetrate the roving yarn, and a portion of the combined filament yarn will form the surface of the spun yarn. In this case, upon twisting, the combined filament yarn covers a mowed portion caused by hemp included in the roving yarn, and thus the possibility of mowing in the produced spun yarn can be significantly reduced.

However, even in this case, a significant portion of the surface of the produced spun yarn is composed of the roving yarn whose mowing was blocked, and thus the produced spun yarn can retain the characteristics of hemp. Meanwhile, the combined filament yarn has a structure in which a low-stretchability filament yarn having strong durability surrounds a high-stretchability filament yarn. Thus, the anti-peeling property of the produced spun yarn can further be increased by the combined filament yarn exposed to the surface, and the stretchability of the produced spun yarn can be exhibited by the high-stretchability filament yarn inside the combined filament yarn.

As described above, the hemp-blended single spun yarn produced according to the present invention may have excellent anti-peeling and durability properties due to reduced mowing and the blended low-stretchability filament yarn according to the above-described mechanism, and may have very excellent stretchability due to the blended latent and potential crimped yarn and high-stretchability filament yarn, compared to conventional spun yarns made of hemp.

Finally, if the entry position of the combined filament yarn exceeds 20% of the final twisting number, a portion of the combined filament yarn supplied as a core yarn will penetrate the roving yarn while the combined filament yarn surrounds the roving yarn, and the remaining portion will protrude from the surface of the produced spun yarn. In this case, the combined filament yarn can reduce mowing while it covers a mowed portion caused by hemp included in the roving yarn, but a significant portion of the combined filament yarn will protrude from the surface of the produced spun yarn, and thus expression of the characteristic advantages of hemp can necessarily be lower than that in the present invention, and the elongation of the produced spun yarn is also reduced.

Figure 7:
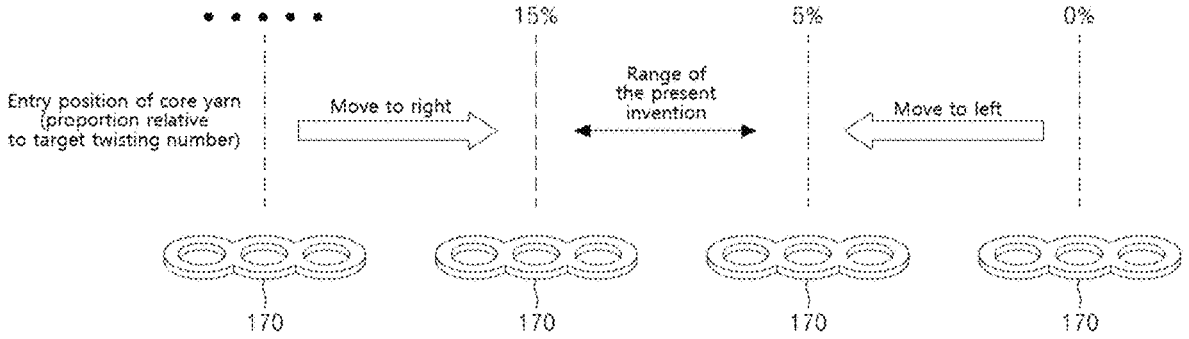
FIG. 7 is a conceptual view illustrating a mechanism that adjusts the entry position of a combined filament yarn (which is a core yarn) in a method of producing a hemp-blended single spun yarn according to the present invention.

FIG. 7 is a conceptual view illustrating a mechanism that adjusts the entry position of a combined filament yarn (which is a core yarn) in the method of producing the hemp-blended single spun yarn according to the present invention. For reference, the conceptual view of FIG. 7 assumes that the core yarn enters from the right side as described above with reference to FIGS. 3 to 5.

Referring to FIG. 7, when the entry position of the core yarn according to the present invention is more than 5% of the final target twisting number in a state in which the vertical position is fixed, the tension control ring unit 170 is moved to the left side (that is, the tension control ring unit is moved close to the roving yarn), and thus tension control is performed such that the core yarn enters a position corresponding to 5 to 20% of the target twisting number, which is the entry position according to the present invention. When the entry position of the core yarn is a lower portion corresponding to more than 20% of the target twisting number, the entry position of the core yarn can be adjusted by moving the position of the tension control ring unit 170 to the right side (that is, spacing the position apart from the roving yarn).

Namely, in the method of producing the hemp-blended single spun yarn according to the present invention, the entry position of the combined filament yarn in the spinning machine can be easily adjusted by horizontally moving the tension control ring unit in a state in which vertical movement is fixed. Meanwhile, in other embodiments of the present invention, in order to adjust the entry position of the combined filament yarn as a core yarn, the position of the tension control ring unit may be moved vertically in a state in which horizontal movement is fixed, or both the horizontal position and vertical position of the tension control ring unit may be adjusted.

Figure 8A:
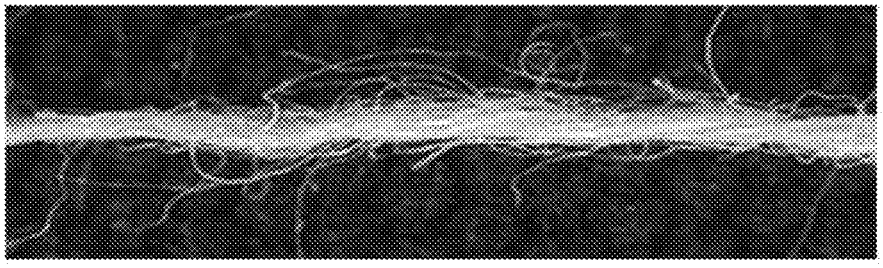
FIGS. 8A-8B depict enlarged side view photographs comparing the extents of mowing between a single yarn produced by a method of producing a hemp-blended single spun yarn according to the present invention and a single yarn produced by a conventional spinning process.
Figure 8B:
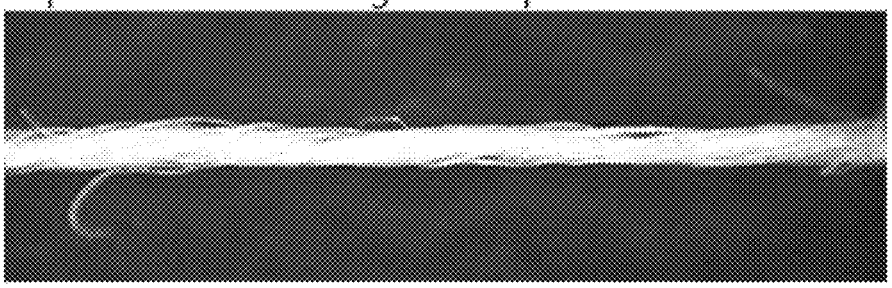

FIGS. 8A-8B depict enlarged photographs comparing the extent of mowing between a single yarn produced by the method of producing the hemp-blended single spun yarn according to the present invention and a single yarn produced by a conventional spinning step.

For reference, in all the examples shown in FIGS. 8A and 8B, a sliver including a blend of hemp fiber and latent and potential crimped yarn fiber was supplied as a roving yarn, and a combined filament yarn was supplied as a core yarn. Referring to FIGS. 8A and 8B, it can be seen that mowing of the hemp-blended single spun yarn produced according to the present invention was significantly reduced compared to that of a hemp-blended single spun yarn produced by a conventional method.

Figure 9:
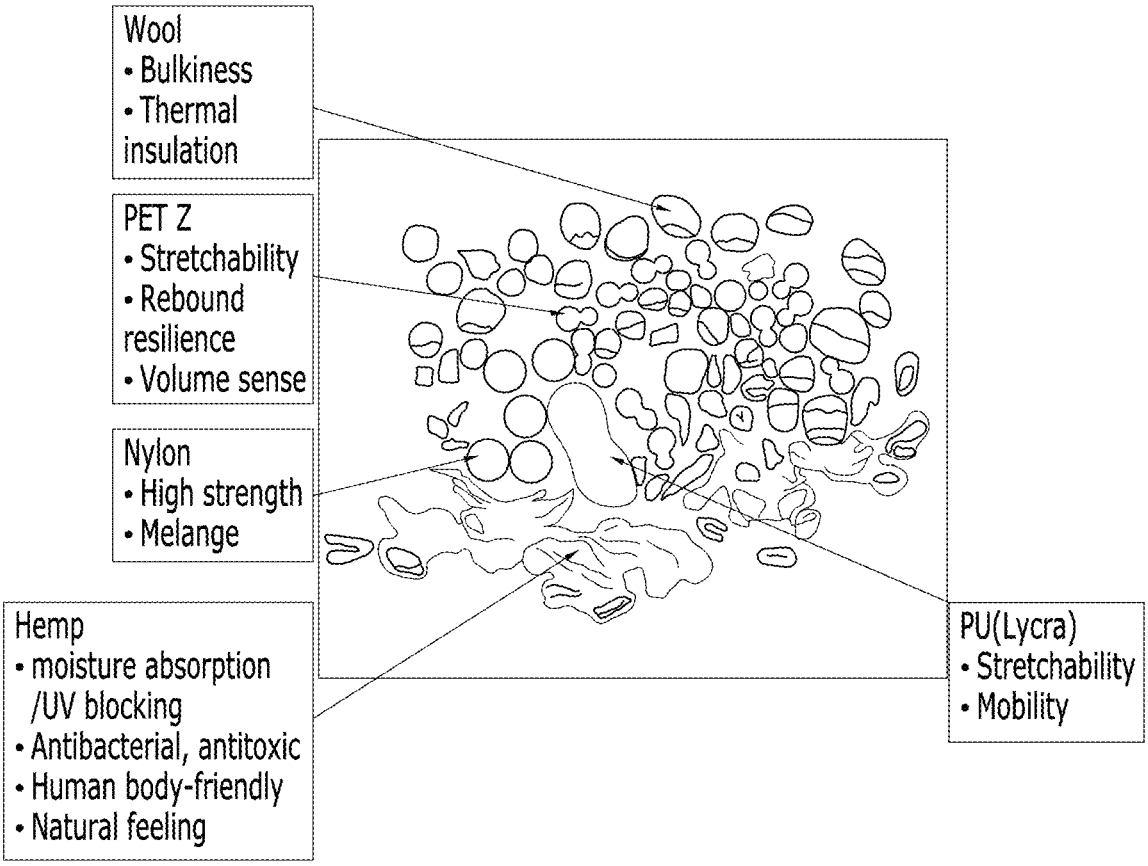
FIG. 9 is an enlarged view of the cross section of a hemp-blended single spun yarn produced according to the present invention.

FIG. 9 is an enlarged photograph of the cross section of the hemp-blended single spun yarn produced according to the present invention.

Referring to FIG. 9, the combined filament yarn having a structure in which a low-stretchability filament yarn made of nylon surrounds a high-stretchability filament yarn made of polyurethane (PU) penetrates the hemp-blended single spun yarn while it forms a portion of the surface of the hemp-blended single spun yarn. Due to this cross-sectional structure, hemp-blended single spun yarn produced according to the present invention can retain the characteristics of hemp and, at the same time, have strong durability and anti-peeling properties and also have stretchability. For reference, in the embodiment shown in FIG. 9, wool for improving thermal insulation is blended.

As described above, the method of producing the hemp-blended single spun yarn according to the present invention may provide the effect of dramatically increasing spinning efficiency by spinning a blend of hemp fiber and latent and potential crimped yarn fiber to overcome the disadvantage of hemp having weak cohesion.

Furthermore, the method of producing the hemp-blended single spun yarn according to the present invention can overcome the disadvantages of hemp, which gives low wearing comfort and mobility due to its characteristic stiffness, rigidity and non-stretchability, by blending of latent and potential crimped yarn fiber, and thus can retain the characteristic advantages of hemp and also provide the effect of giving excellent wearing comfort and mobility due to its stretchability.

In addition, the method of producing the hemp-blended single spun yarn according to the present invention can provide the effect of minimizing mowing in the spinning step by overcoming the disadvantage of hemp, which is excessive mowing compared to other fibers.

Although the present invention has been described in connection with the limited exemplary embodiments and the drawings, the present invention is not limited to these embodiments, and it will be apparent to those skilled in the art that various changes and modifications may be made based on the description.

Therefore, the scope of the present invention should not be defined by the above-described embodiments, but should be defined by the appended claims and equivalents thereto.

What is claimed is:

1. A method of producing a hemp-blended single spun yarn, the method comprising:

a fiber blending step of passing hemp fiber, together with latent crimped yarn fiber, through an opener in order to increase cohesion of the hemp fiber by a three-dimensional chain structure of the latent crimped yarn fiber, thereby producing a blended fiber comprising 10% to 60% latent crimped yarn fiber;

a sliver production step of carding the blended fiber through a carding machine, and drafting the carded fiber through a drafting machine, thereby producing a sliver; and a spinning step of supplying the sliver as a roving yarn through a plurality of rollers to a twisting unit, and supplying a combined filament yarn, produced by twisting and having a structure in which a first filament yarn having a first predetermined stretchability surrounds a second filament yarn having a second predetermined stretchability, the first predetermined stretchability being lower than the second predetermined stretchability, as a core yarn to the twisting unit without being passed through the plurality of rollers, wherein the combined filament yarn enters a position on top of the twisting unit, at which twisting of 5% to 20% of a predetermined twisting number for the hemp-blended single spun yarn is performed, wherein the combined filament yarn is unwound from a winding unit at a constant speed, descends via a guiding bar, passes vertically in a zigzag pattern (downward, upward and then downward) through three horizontally interconnected rings provided in a tension control ring unit, and enters the position at which twisting of 5% to 20% of the predetermined twisting number for the hemp-blended single spun yarn is performed.

2. The method of claim 1, further comprising a step of either spraying a mixture solution of water and an emulsifier during a process in which the blended fiber is discharged through the opener or during a process in which the fibers are supplied to the opener, or aging the hemp fiber by spraying a mixture solution of water and an emulsifier thereto in an aging room before the hemp fiber is supplied to the opener.

3. The method of claim 1, wherein the entry position of the combined filament yarn is adjusted either by horizontally moving the tension control ring unit in a state in which vertical movement is fixed, or by vertically moving the tension control ring unit in a state in which horizontal movement is fixed.

* * * * *